United States Patent [19]

Zehnder

[11] 3,987,824

[45] Oct. 26, 1976

[54] WATER GLASS FILLER

[76] Inventor: Fred W. Zehnder, 590 Frederick St., Frankenmuth, Mich. 48734

[22] Filed: Jan. 27, 1975

[21] Appl. No.: 544,140

[52] U.S. Cl. ..... 141/99; 141/104; 141/238; 222/129.4

[51] Int. Cl.[2] ..... B65B 1/04; B65B 3/04

[58] Field of Search ..... 53/390; 137/602; 141/9, 141/83, 98, 99, 100, 102, 104, 105, 234, 237–244, 359; 222/129.1, 129.3, 129.4, 429, 431, 451; 241/DIG. 17

[56] References Cited

UNITED STATES PATENTS

| | | | |
|---|---|---|---|
| 1,139,269 | 5/1915 | Goodman et al. | 222/429 |
| 3,181,739 | 5/1965 | Dye | 222/429 X |
| 3,893,494 | 7/1975 | Whitney | 141/244 |

*Primary Examiner*—Richard E. Aegerter
*Assistant Examiner*—Frederick R. Schmidt

[57] ABSTRACT

Apparatus for simultaneously filling each of a standard trayful of glasses with a metered mixtures of ice cubes and water. The bottom of an ice cube supply bin is defined by a flat plate having openings arranged in correspondence with the location of glasses in a standard tray. A grid-like shutter is slidably supported upon the plate and may be shifted to selectively block or unblock the openings in the plate to prevent or permit ice cubes to drop from the bin through the openings in the plate. Open-ended metering tubes extend downwardly from the plate at each opening, the tubes having an internal volume of approximately one-half of that of the glasses to be filled. A second grid-like shutter is slidably mounted immediately below the lower ends of the tubes to selectively block or unblock the lower end of the tubes. A nozzle connected to a water supply source is mounted on each tube to discharge water downwardly into the underlying glass. A support platform with locating means is mounted below the apparatus to support a trayful of glasses to be filled in vertical alignment with the respective tubes. By shifting the upper plate to its open position while the lower plate blocks the lower ends of the tubes, the tubes are gravitationally filled with ice cubes from the bin. The upper plate is returned to its blocking position and subsequent shifting of the lower plate to its open position drops a measured charge of ice cubes from the tubes into each of the underlying glasses. A time-controlled valve or other suitable metering system is actuated to discharge a metered amount of water into each glass through the respective nozzles. The nozzles may include a petcock or other individually adjustable valve to assure the discharge of an equal volume of water from each nozzle.

12 Claims, 8 Drawing Figures

WATER GLASS FILLER

BACKGROUND OF THE INVENTION

The present invention is especially designed for use in restaurants or commercial dining rooms where substantial numbers of glasses of ice water are required. In most restaurants, empty glasses are stocked at a serving station which has an ice cube bin and a water dispensing nozzle and the glasses are filled individually by the waiters or waitresses as needed. While this system in general is satisfactory for low volume operations, it presents several problems in busier operations, particularly during peak periods. One obvious drawback is that a certain amount of time is required to put ice cubes into a glass and to then subsequently fill the glass with water. Where this task must be repeated for each individual glass to be filled, a substantial amount of a busy watress's time can be consumed. A second problem is one of sanitation in that, when pressed for time, the person filling the glass will frequently dip the glass into the ice cube bin, rather than using the ice cube scoop, thus brushing their hands through cubes in the bin.

The present invention is especially designed to simultaneously deposit into each glass of a trayful of glasses a measured volume of ice cubes and to simultaneously fill each of the glasses with a metered volume of water. The apparatus is so designed that its operation is completely controlled from the exterior of the apparatus so that manual handling or contact with the ice cubes is avoided.

SUMMARY OF THE INVENTION

Glasses to be filled by the present apparatus are loaded into the apparatus in a standard tray which, in the usual case, will hold 36 glasses in individual compartments within the tray. The trayful of glasses to be filled is placed and located on a filling station at a lower level of the apparatus. At a location spaced above the glasses when at the filling station, an ice cube supply bin is fixedly mounted. The bin may either be manually filled or connected directly to the outlet of an ice cube maker. The bottom of the bin is constituted by a flat plate having a series of openings located to be in vertical alignment with the respective glasses contained in the tray at the filling station. A grid-like shutter member is slidably mounted on the plate for movement between a blocking position in which cross strips of the grid-like shutter overlie the openings in the plate to prevent ice cubes from dropping from the bin through the plate openings, and an open position in which the cross strips are located between adjacent rows of openings so that the openings are unblocked and ice cubes can drop freely from the bin through the openings. Open ended tubes are mounted on the plate to project downwardly from each opening, the internal volume of each tube being approximately one-half that of a glass to be filled. A second grid-like shutter is slidably mounted immediately below the lower ends of the tube and likewise includes cross strips which, in a blocking position, will prevent ice cubes from dropping from the tubes into the underlying glasses. The lower shutter member can be withdrawn to an open position to permit ice cubes to drop from the tubes into the glasses.

A water dispensing nozzle is mounted on each tube to discharge water into the underlying glass. The nozzles are connected via manifold type connections to a water supply source. Each nozzle is preferably provided with an individual petcock type valve so that water is discharged at an equal rate from all nozzles. The water supply system is preferably controlled by a timer control valve which automatically closes at a set time interval after its initial opening.

In a filling operation, both upper and lower shutters are initially located in their closed position and the water supply source is off. The upper shutter is first shifted to allow cubes to drop from the bin into the tubes. When the tubes are filled with ice cubes, the upper shutter is returned to its original blocking position, the edges of the cross strips preferably being sharpened to assist in shearing or chipping ice cubes which may be partially projected from the tubes above the plate. This finds each of the tubes filled with a measured volume of ice cubes which, as determined by the tube dimensions is preferably chosen to be approximately one-half that of the glass to be filled.

Upon shifting of the lower shutter member to its open position, the ice cubes drop from the tubes into the underlying glasses, each glass being approximately half filled with ice cubes. The water supply source is then actuated to dispense a measured volume of water into each glass to fill each glass with the desired ice cube-water mixture.

Operation of the two shutter members may be coordinated as, for example, by a lever so coupled to the shutter members such that when one shutter member is in its closed position, the other shutter member is in its open position.

Other objects and features of the invention will become apparent by reference to the following specification and to the drawings.

IN THE DRAWINGS

Figure 3:
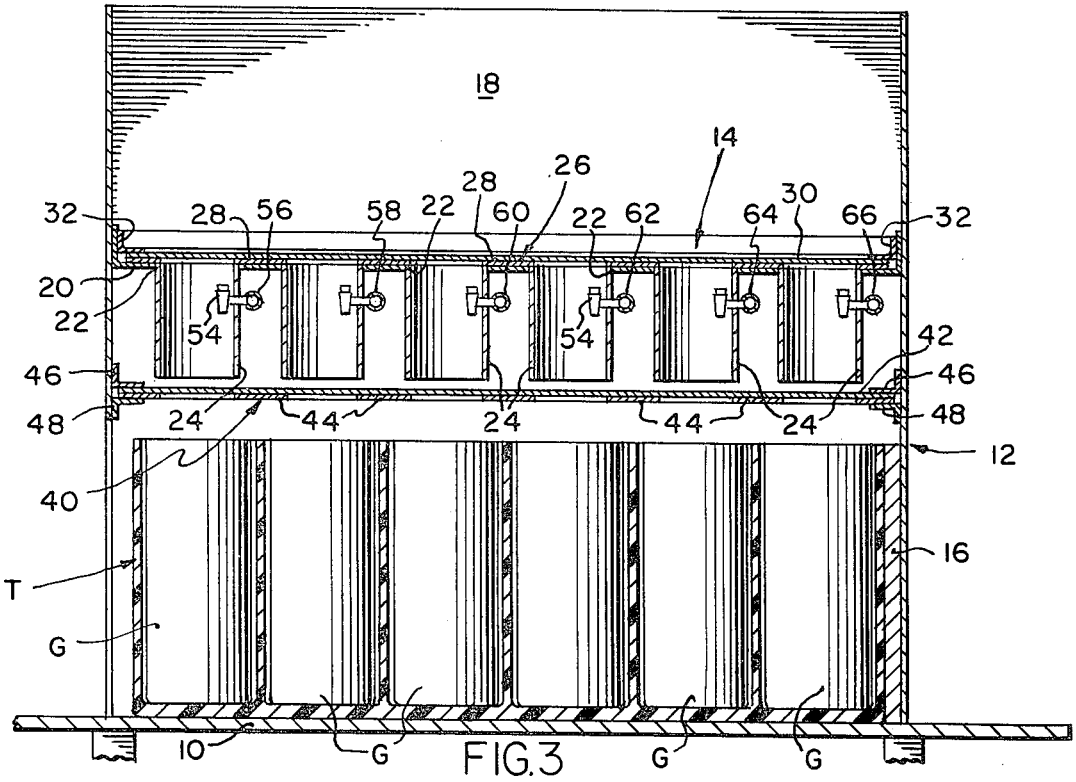
FIG. 3 is a cross-sectional view taken on the line 3—3 of FIG. 1.

Referring first to FIG. 3, there is shown in cross-section an apparatus embodying the present invention with a tray T loaded with empty glasses G positioned in the apparatus to be filled. The trays T are of a standard size determined by the glass washing machines employed by the restaurant and are sub-divided, as shown, to provide an individual compartment for each glass. In the usual case, a typical tray will hold 36 individual glasses G. In FIG. 3, the tray T is supported upn a base plate 10 and a stationary frame designated generally 12 is fixedly secured upon plate 10 to support the filling apparatus designated generally 14 in overlying relationship to tray T. Locating means, such as ribs 16, are mounted on the frame to be engaged by the sides of the tray T to accurately position the glasses within the tray in vertical alignment with the elements of the filling apparatus to be described below.

Apparatus 14 includes an ice cube bin 18 mounted at the top of frame 12 and having its bottom defined by a flat plate 20 having a plurality of circular openings 22 extending through the plate, openings 22 being located so that each opening is vertically aligned with a glass G in a tray T positioned at the filling station. A plurality of open-ended metering tubes 24 are fixedly secured at their upper ends to plate 20 and, as best seen in FIG. 3 project downwardly from the plate with the interior of each tube 24 constituting a continuation of an opening 22.

Figure 1:
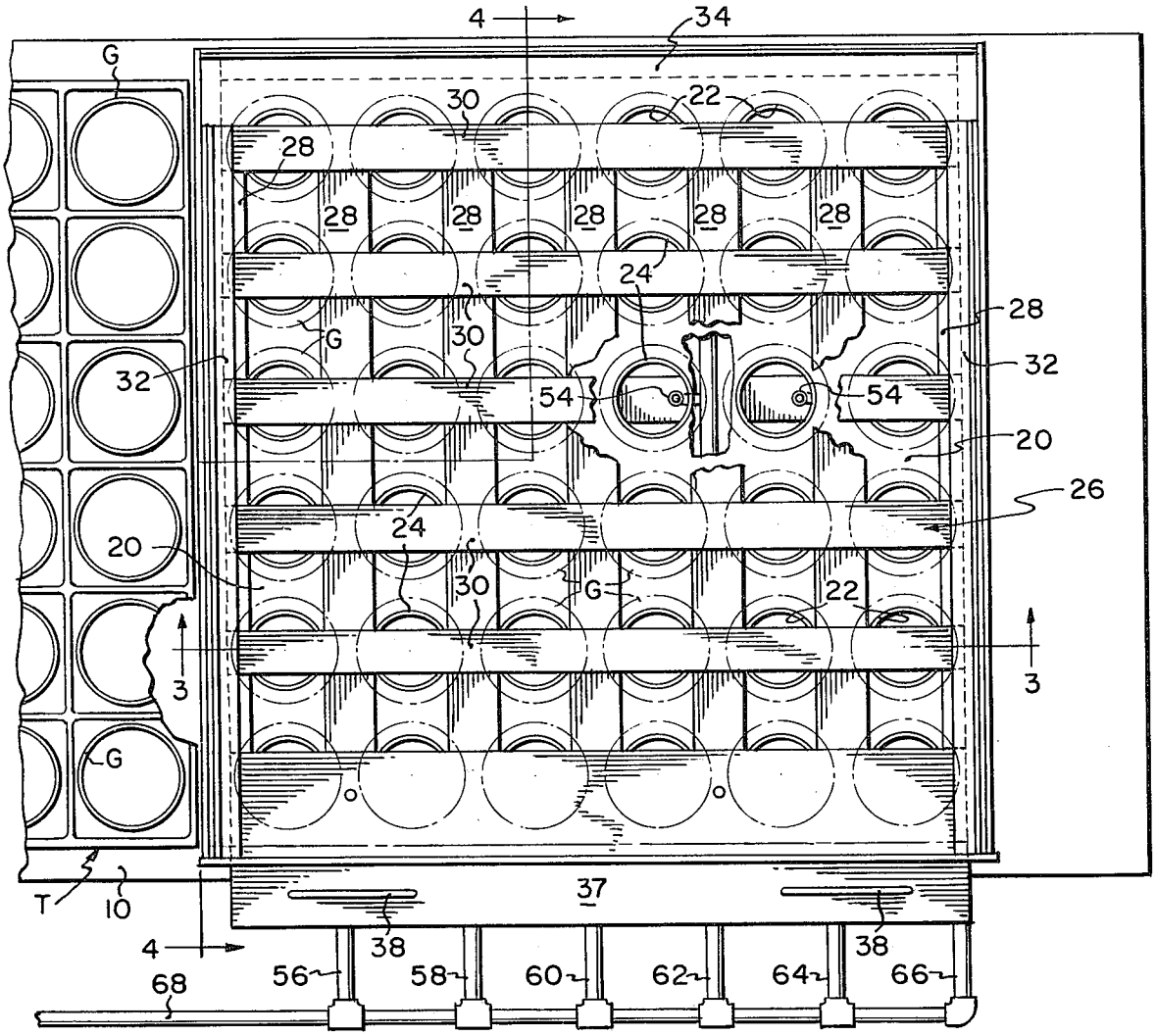
FIG. 1 is a top plan view, with certain parts broken away, of an apparatus embodying the present invention.
Figure 2:
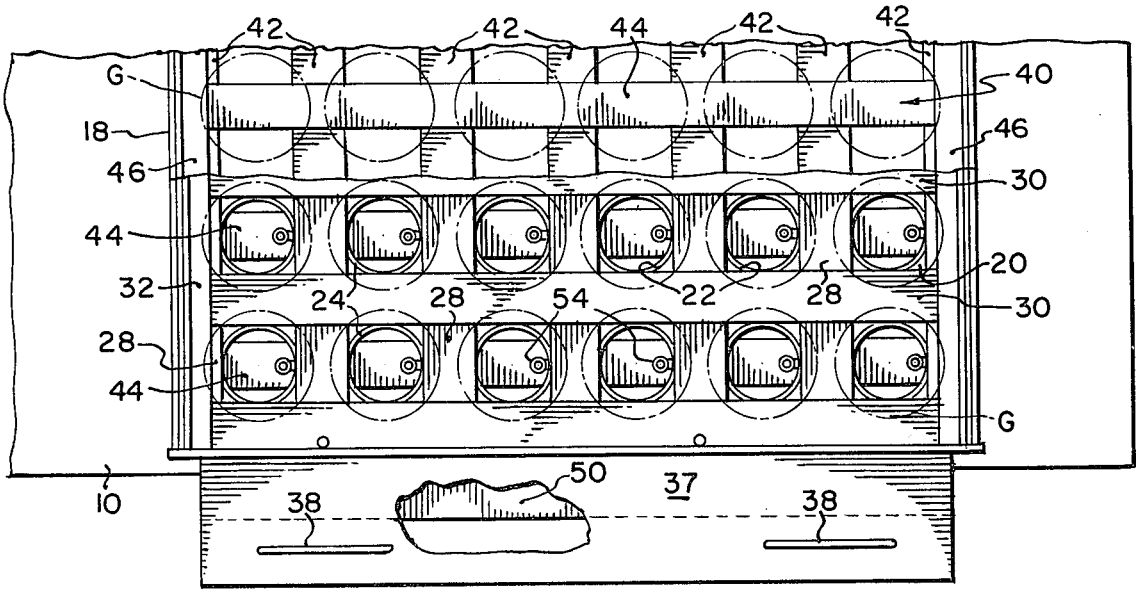
FIG. 2 is a partial top plan view of the apparatus of FIG. 1 showing the upper shutter member in a different position.

To control the flow of ice cubes from bin 18 into tubes 24, a grid-like upper shutter member designated generally 26 is slidably mounted upon the top of plate 20. As best seen in FIG. 1, shutter 26 is formed from a group of longitudinally extending strips 28 and a plurality of transversely extending cross strips 30. Shutter 26 is guided in sliding movement upon plate 20 by flanges 32 fixed to opposed sides of bin 18 and overlying the outermost longitudinal strips 28 at opposite side edges of the shutter. As best seen in FIG. 1, longitudinal strips 28 are so dimensioned as to lie between adjacent rows of openings 22, while cross strips 30 are located to overlie and substantially block openings 22 when shutter 26 is in the closed or blocking position shown in FIG. 1 As seen in FIG. 2, grid 26 can be shfited from the FIG. 1 position to an open position, illustrated in FIG. 2, in which cross strips 30 lie between openings 22 and fully expose the openings to accommodate flow of ice cubes from bin 18 downwardly through the openings.

At the innermost end of shutter 26, a shield plate 34 is fixedly secured to the bin wall and projects outwardly into overlying relationship with grid 26. Shield plate 34 functions to prevent ice cubes from dropping between the bin wall and inner end of shutter 26 when the shutter is withdrawn to the FIG. 2 position. At the outer end of the shutter, the shutter projects outwardly through a slot in the bin wall as at 36 and handles 38 may be fixed to the projecting portion 37 of the shutter for conveneience in manually shifting shutter 26 between the FIG. 1 and FIG. 2 positions.

Figure 4:
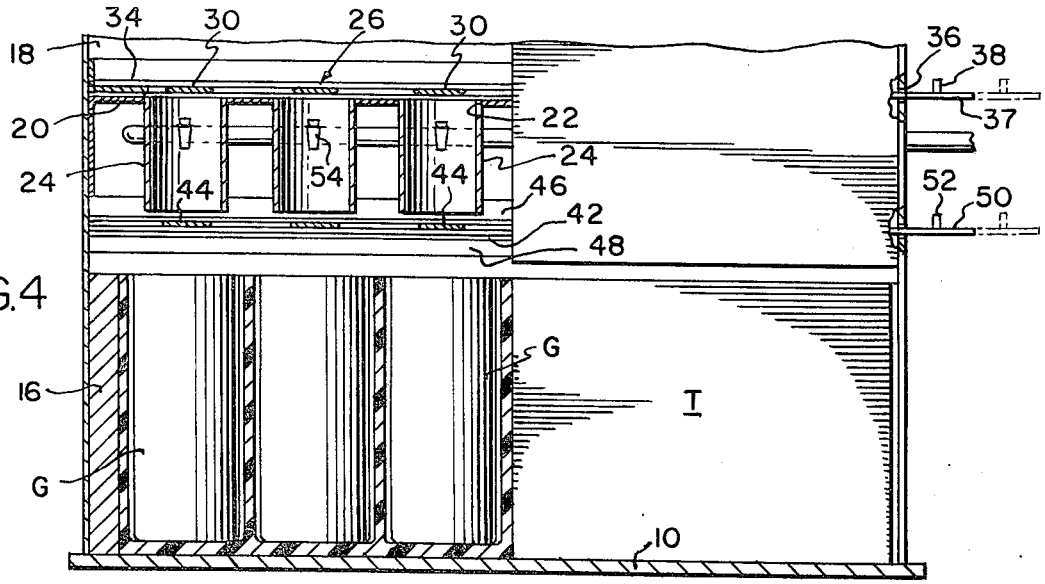
FIG. 4 is an off-set cross-sectional view taken on the ling 4—4 of FIG. 1.
Figure 5:
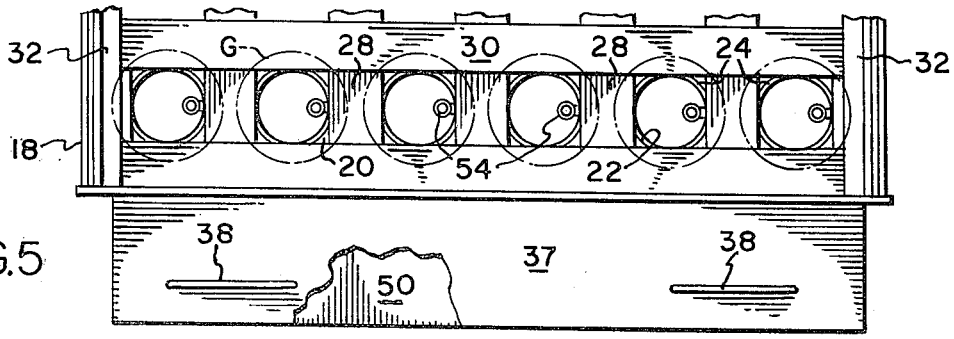
FIG. 5 is a partial top plan view.

A second or lower shutter member designated generally 40 (see particularly FIGS. 3 and 4) is likewise constructed of longitudinal 42 and transverse 44 strips duplicating the pattern of shutter 26. Shutter 40 is slidably supported from frame 12 as by spaced angle brackets 46, 48 (FIG. 3) for sliding movement parallel to the direction of movement of shutter 26 at a location spaced slightly below the lower ends of metering tubes 24. Like upper shutter 26, lower shutter 40 is slidably movable between a blocking position in which its cross strips 44 underlie the open lower ends of tubes 24 and an unblocking position in which cross strips 44 are located out of alignment with tubes 24. When shutter 40 is located in its unblocking positon, any ice cubes within the tubes 24 are free to drop downwardly into the glasses located in vertical alignment under each of the tubes 24. Like shutter 26, shutter 40 projects outwardly from the front of the apparatus as at 50 and handles 52 on the projecting portion 50 may be employed to manually shift shutter 40 between its blocking and unblocking positions.

Figure 6:
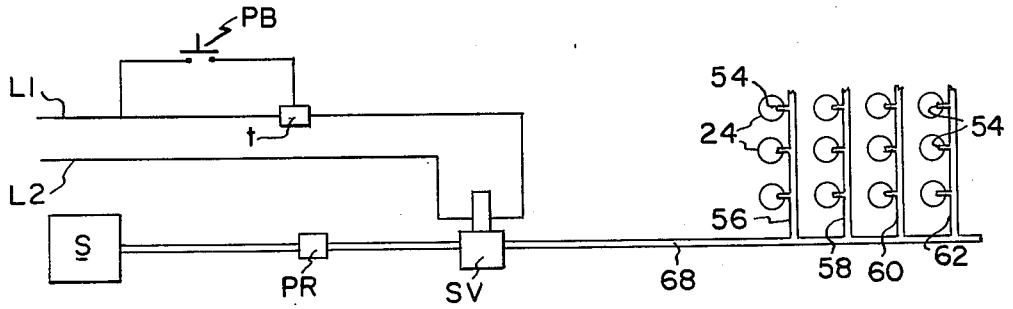
FIG. 6 is a schematic diagram of the water supply system.

A nozzle 54 is mounted on each tube 24, the nozzles in each row of tube 24 being commonly connected to conduits 56, 58, 60, 62, 64 and 66 (FIG. 3), these latter conduits in turn being connected commonly to a supply line 68 (FIG. 6) which is in turn connected via a timer controlled solenoid valve SV and a pressure regulator PR to a water supply source S. The individual nozzles 54 prefrably include an adjustable petcock so that an equal rate of flow of water from each nozzle occurs when conduit 68 is connected to source S upon opening of solenoid valve SV. Because during discharge a pressure drop exists across each nozzle, those nozzles more distant from the supply source must be opened wider than nozzles closer to the source in order to equalize the rate of flow of water from the respective nozzles. The controlling solenoid of solenoid SV is connected to electrical supply lines L1, L2 through a timer *t* which is adjusted to maintain solenoid valve SV open for a predetermined time interval, for example, about 7 seconds, upon a momentary depression of push button PB and to then close the solenoid valve.

Referring now particularly to FIG. 3, it will be noted that metering tubes 24 have an internal volume of approximately one half that of the glasses they are to fill. This relationship results in the supplying to each glass, by the operation to be described below, of a volume of ice which will approximately fill the glass about half full of ice cubes. Because tubes 24 thus are of smaller overall dimensions than the glass, nozzles 54 in some instances may be more conventiently mounted on the exterior of the tube so that the nozzles do not project into the path of ice cubes. Because the cubes may typically have dimensions of one half inch on each side, it is not necessary that the upper and lower shutter members 26 and 40 be close fitting nor that cross strips 30 and 44 completely block the open ends of the tubes.

Operation of the apparatus is as follows. With upper shutter 26 positioned in the blocking position of FIG. 1, bin 18 is filled with ice cubes, lower shutter 40 is moved to its blocking position and a trayful of glasses to be filled is positioned beneath the apparatus with the glasses respectively in alignment with the tubes 24. Upper shutter 26 is then shifted from its blocking position of FIG. 1 to its open position shown in FIG. 2, thus permitting ice cubes to gravitationally fall from the bin into tubes 24 to fill the tubes, shutter 40 in its blocking position preventing the ice cubes from dropping from the lower ends of the tubes.

Upper shutter 26 is then returned to the blocking position shown in FIG. 1. In the normal course of events, the return of shutter 26 to its blocking position will be resisted by ice cubes which may partially project upwardly from tubes 24 above plate 20. To facilitate the returning of shutter 26 to its original blocking position, the edges of cross strips 30 of shutter 26 may be sharpened to enable the shutter to shear through cubes of this type or alternatively, a lever mechanism such as 70 (FIGS. 7 and 8) may be employed to shift the shutters between their open and closed positions. The cubes normally do not completely pack tightly within tubes 24 and hence in most cases a projecting cube can be shifted somewhat to provide the necessary clearance to permit shutter 26 to return to its closed position.

After shutter 26 has returned to its closed position, lower shutter 40 is moved to its unblocking position to permit the measured quantity of ice cubes within the tubes 24 to drop from the tubes into the underlying glasses.

Pushbutton PB is then depressed to actuate timer T which opens solenoid valve SV for a predetermined time interval to permit water to flow from manifold 68 through the various branch conduits 56, 58, etc. to the individual nozzles. As explained above, each of the nozzles is individually adjusted so that an equal flow rate at all nozzles is achieved and with this adjustment, by appropriate adjustment of the timer *t*, a measured volume of water is discharged from the nozzles into each of the underlying glasses.

Lower shutter 40 is then returned to its blocking position and the filled tray of glasses is removed.

Figure 7:
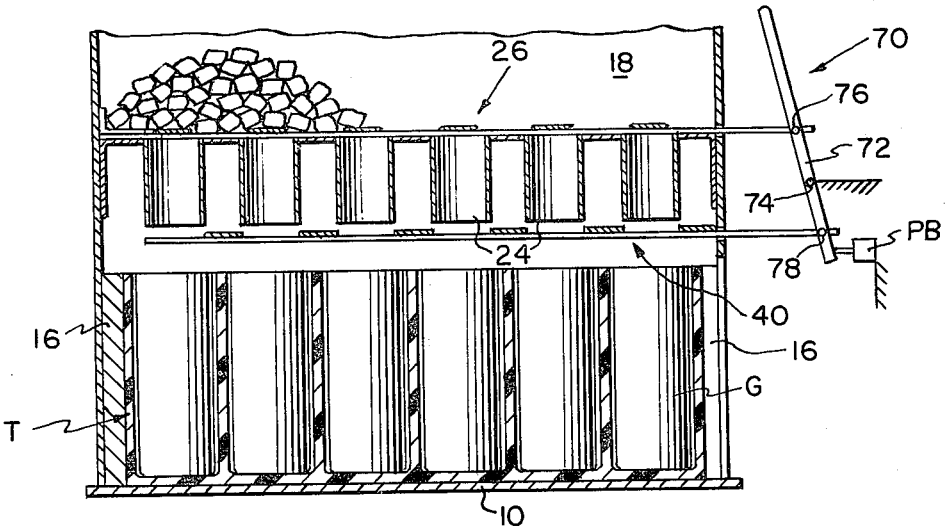
FIGS. 7 and 8 are schematic cross-sectional views showing an arrangement for coordinating actuation of the shutter means.
Figure 8:
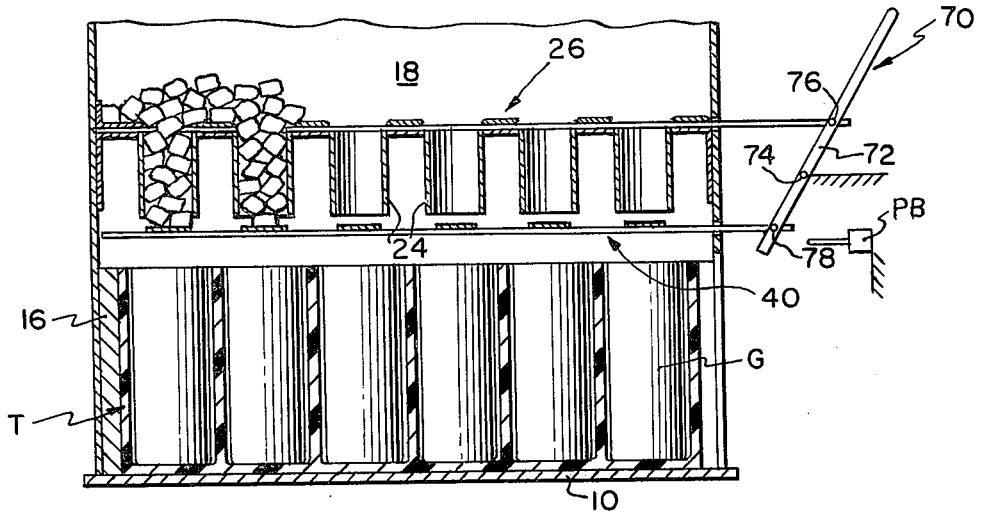

The foregoing description of the operation has assumed that each of upper and lower shutters 26 and 40 is manually shifted as required. In FIGS. 7 and 8, a schematic diagram of a lever arrangement 70 is disclosed for coordinating movement of the respective shutters. This arrangement may include a lever 72 pivotally mounted on a stationary or fixed pivot 74 and pivotally connected on opposite sides of pivot 74, respectively to upper shutter 26 and the lower shutter 40. Operation of this embodiment is believed apparent from FIGS. 7 and 8, the connections between the shutters and lever 72 assuring that as one of the two shutters is moved to its open position, the other shutter is being moved to its blocking position.

Preferably push bottom PB may be mounted as schematically shown in FIGS. 7 and 8 to be depressed by lever 70 when lower shutter 40 is moved to its open position. This arrangement would require electrical reset circuitry of a type well known in the art in timer *t* so that continued depression of pushbotton PB would not cause a continuing recycling of valve SV.

While exemplary embodiments of the invention have been described above, it will be apparent to those skilled in the art that the disclosed embodiment may be modified. Therefore, the foregoing description is to be considered exemplary rather than limiting, and the true scope of the invention is that defined in the following claims.

I claim:

1. Apparatus for filling a trayful of glasses with a measured mixture of ice cubes and liquid, said apparatus comprising locating means for supporting and locating a trayful of glasses to be filled at a filling station, a plurality of like open ended vertically disposed tubes, mounting means mounting said tubes above said filling station with each tube located in vertical alignment with a glass in a trayful of glasses at said filling station, the internal volume of one of said tubes being less than that of a glass to be filled, ice cube containing bin means mounted above said tubes, first shutter means mounted above said tubes for movement between a closed position blocking communication between said bin means and said tubes and an open position accommodating gravitational flow of ice cubes from said bin means simultaneously into said tubes, second shutter means mounted below said tubes for movement between a closed position blocking the lower ends of said tubes to retain ice cubes therein and an open position accommodating gravitational flow of ice cubes from said tubes into the underlying glasses in said trayful of glasses, means for shifting each of said first and second shutter means between their open and closed positions in opposite directions so that the second blocking mechanisms are in closed positions when the first blocking mechanisms are shifted to open positions to pass ice into the upper ends of the tubes and the first blocking mechanisms are in closed positions when the second blocking mechanisms are moved to open positions to release ice cubes to the glasses, liquid supply means on each of said tubes, and control means operable when the first blocking mechanisms are moved to closed positions to cut off ice flow into the tubes for actuating said liquid supply means to dispense from said liquid supply means a measured volume of liquid substantially simultaneously into each of said tubes and through the tubes into the underlying glasses.

2. The invention defined in claim 1 wherein said mounting means comprises a horizontal plate fixedly secured to the upper ends of said tubes, said plate having openings therethrough aligned with the interior of each of said tubes and said first shutter means comprises a grid-like member slidably supported upon the upper surface of said plate and having openings therethrough movable into and out of alignment with the openings in said plate upon movement of said first shutter means between its open and closed positions, said plate and said first shutter means defining the bottom of said bin means.

3. The invention defined in claim 2 wherein said grid-like member is of over-all rectangular configuration having a first edge disposed at one side of said bin when said first shutter means is in one of its open and closed positions and spaced from said one side of said bin when said first shutter means is in the other of its open and closed positions, and a shield plate projecting from said one side of said bin to overlie said first edge throughout its range of movement between said open and closed positions.

4. The invention defined in claim 2 wherein said openings in said plate are circular openings centered on the intersections of first and second sets of uniformly spaced parallel lines, said first and second sets of lines being perpendicular to each other, and said first shutter means comprises first and second sets of uniformly spaced parallel strip members fixedly secured to each other with said first and second sets of strips perpendicular to each and dimensioned to lie entirely between said openings when said first shutter means is in said open position, said first shutter means being movable parallel to said first set of strips during movement between its open and closed positions and said second set of strips overlying the centers of said openings in said plate when said first shutter means is in said closed position.

5. The invention defined in claim 4 wherein said second strips are formed with sharpened edges along the sides of said strips facing said closed position to shear ice cubes partially projecting from said tubes during return of said first shutter means to said closed position.

6. The invention defined in claim 1 wherein each of said liquid supply means comprises a nozzle, and means for adjustably controlling the rate of flow from said nozzle to equalize the rate of discharge of liquid into the underlying glasses.

7. The invention defined in claim 6 comprising conduit means connecting each of said nozzles to a common liquid supply conduit, and time controlled valve means in said common conduit operable when opened to close after a predetermined time interval has elapsed.

8. Apparatus for filling a trayful of glasses with a measured mixture of ice cubes and liquid, said apparatus comprising a plurality of vertically disposed open ended tubes fixedly mounted in an adjacent relationship to each other corresponding to the locations of glasses in a tray, means for supporting a trayful of glasses to be filled in underlying relationship to said tubes with each tube in vertical alignment with a glass in the tray, ice cube supply means, first movable means normally disposed to isolate said tubes from said supply means and first shifting means for moving said first movable means from its normally disposed position to an open position placing said tubes in communication with said supply means to fill each of said tubes with ice cubes from said supply means, second movable means normally disposed in a position blocking the lower ends of said tubes, second shifting means for moving said second movable means from said normally disposed position to an open position to simultaneously release ice cubes from said tubes into the underlying glasses, liquid supply means for filling each of said glasses substantially simultaneously with a measured volume of liquid operating said first and second shifting means and for similtaneously operating said second shifting means and said liquid supply means.

9. The invention defined in claim 8 wherein said liquid supply means comprises a liquid supply source, a nozzle mounted on each of said tubes, conduit means connecting said nozzles to said supply means, and valve means for controlling the flow of liquid in said conduit means.

10. The invention defined in claim 9 wherein said valve means comprises a main on-off valve controlling flow of liquid from said liquid supply means to all of said nozzles, and petcock means at each of said nozzlles for adjustably regulating the flow from each individual nozzle.

11. The invention defined in claim 10 further comprising timing means for automatically closing said main on-off valve at a predetermined time interval after said main valve is opened.

12. Apparatus for filling a trayful of glasses with a measured mixture of ice cubes and liquid, said apparatus comprising means for supporting a trayful of glasses to be filled at a filling station, a plurality of like open ended vertically disposed tubes, mounting means mounting said tubes above said filling station with each tube located in vertical alignment with a glass in a trayful of glasses at said filling station, the internal volume of each one of said tubes being less than that of a glass to be filled, ice cube containing bin means mounted above said tubes, first blocking mechanisms mounted above said tubes for movement between closed positions blocking free communication between said bin means and said tubes and open positions accommodating gravitational flow of ice cubes from said bin means simultaneously into said tubes, second blocking mechanisms mounted below said tubes for movement between closed positions blocking the lower ends of said tubes to retain ice cubes therein and open positions accommodating gravitational flow of ice cubes from said tubes into the underlying glasses in said trayful of glasses, means supporting each of said first and second blocking mechanisms in opposite directions so that the second blocking mechanisms are in closed positions when the first blocking mechanisms are shifted to open positions to pass ice into the upper ends of the tubes and the first blocking mechanisms are in closed positions when the second blocking mechanisms are moved to open positions to release ice cubes to the glasses, and liquid supply means on each of said tubes manually operable to automatically dispense a measured predetermined volume of liquid into each of said tubes and through the tubes into the glasses.

* * * * *

UNITED STATES PATENT AND TRADEMARK OFFICE

CERTIFICATE OF CORRECTION

PATENT NO. : 3,987,824
DATED : 10/26/76
INVENTOR(S) : Fred W. Zehnder

It is certified that error appears in the above-identified patent and that said Letters Patent are hereby corrected as shown below:

Column 2, line 10, after "allow" insert -- ice -- ; line 15, change "projected" to -- projecting -- ; line 47, change "ling" to -- line -- ; line 62, change "upn" to -- upon -- .

Column 3, lines 42-43, change "conveneience" to -- convenience -- .

Column 4, line 5, change "prefrably" to -- preferably -- ; line 27, change "conventiently" to -- conveniently -- .

Column 5, line 18, after "and" omit "the".

Column 7, line 17, after "liquid" insert -- and control means for alternately -- ; line 29, change "nozzlles" to -- nozzles -- .

Column 8, line 24, after "mechanisms" insert -- for shifting movement of the first and second blocking mechanisms -- .

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*